US006389755B1

(12) United States Patent
Wenner

(10) Patent No.: US 6,389,755 B1
(45) Date of Patent: May 21, 2002

(54) GUTTER AND DOWNSPOUT SYSTEM FOR FACILITATING CLEAN OUT AND PREVENTION OF BREAKAGE DUE TO ICE DAM BUILDUP

(76) Inventor: Carl F. Wenner, 66 Yaphank-Middle Island Rd., Middle Island, NY (US) 11953

( * ) Notice: Subject to any disclaimer, the term of this patent is extended or adjusted under 35 U.S.C. 154(b) by 0 days.

(21) Appl. No.: 09/688,912

(22) Filed: Oct. 16, 2000

(51) Int. Cl.[7] ..... E04D 13/08; E04D 13/064

(52) U.S. Cl. ..... 52/16; 52/11; 248/48.1; 248/48.2

(58) Field of Search ..... 52/11, 12, 16; 248/48.1, 48.2

(56) References Cited

U.S. PATENT DOCUMENTS

| | | | | | |
|---|---|---|---|---|---|
| 304,425 | A | * | 9/1884 | Gould | 248/48.2 |
| 514,758 | A | * | 2/1894 | Lewis | 248/48.2 |
| 3,355,895 | A | * | 12/1967 | Bayes et al. | 52/11 X |
| 4,061,151 | A | * | 12/1977 | Ward | 52/11 X |
| 4,072,285 | A | * | 2/1978 | Greenwood | 52/11 X |
| 4,309,792 | A | | 1/1982 | Faye | |
| 4,745,657 | A | | 5/1988 | Faye | |
| 4,813,190 | A | * | 3/1989 | Wittig | 52/11 |
| 4,837,987 | A | * | 6/1989 | Fender | 52/11 |
| 5,038,528 | A | * | 8/1991 | Brant | 52/11 |
| 5,146,718 | A | * | 9/1992 | Baskett | 52/11 |
| 5,184,435 | A | * | 2/1993 | Sherman | 52/12 |
| 5,274,965 | A | | 1/1994 | Jackson | |
| 5,317,843 | A | * | 6/1994 | Sheehan | 52/11 |
| 5,335,460 | A | | 8/1994 | Smith, Jr. | |
| 5,526,611 | A | * | 6/1996 | Leahy | 52/11 |
| 5,893,239 | A | | 4/1999 | Leahy | |
| 6,240,679 | B1 | * | 6/2001 | Smalara | 52/16 |

* cited by examiner

*Primary Examiner*—Carl D. Friedman
*Assistant Examiner*—Brian E. Glessner
(74) *Attorney, Agent, or Firm*—Richard L. Miller

(57) ABSTRACT

A gutter and downspout system for retractably mounting to a structure and facilitating clean out and prevention of breakage due to ice dam buildup. The system includes a gutter arrangement that retractably mounts to the structure and facilitates clean out and prevention of breakage due to ice dam buildup and a downspout arrangement that detachably mounts to the gutter arrangement and retractably mounts to the structure and facilitates clean out and prevention of breakage due to ice dam buildup. The gutter arrangement includes a bracket that retractably mounts to the structure and a gutter that detachably mounts to the bracket. The downspout arrangement includes a bracket that retractably mounts to the structure and a downspout that detachably mounts to the bracket. The bracket of each of the gutter arrangement and the downspout arrangement includes a stationary portion that is affixed to the structure and a movable portion that is pivotally mounted to the stationary portion thereof.

44 Claims, 2 Drawing Sheets

FIG.8
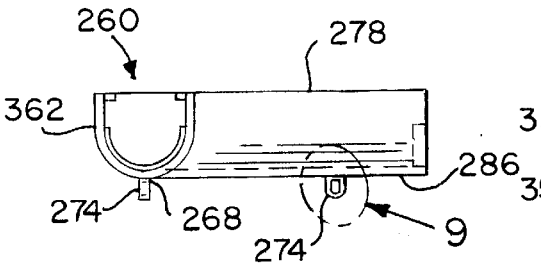
FIG.12
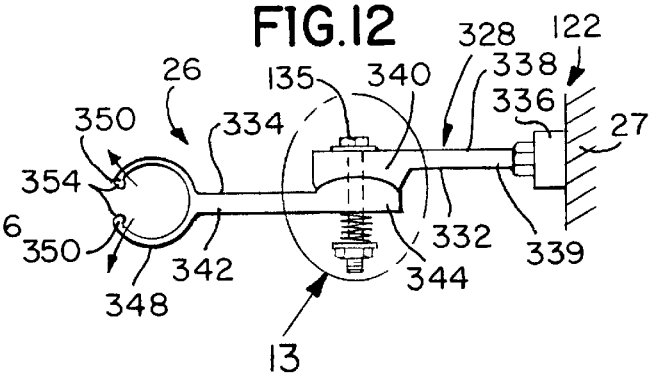
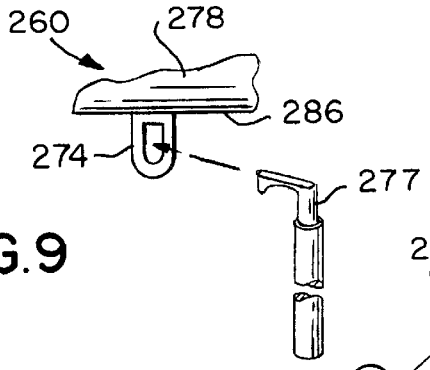
FIG.9
FIG.1
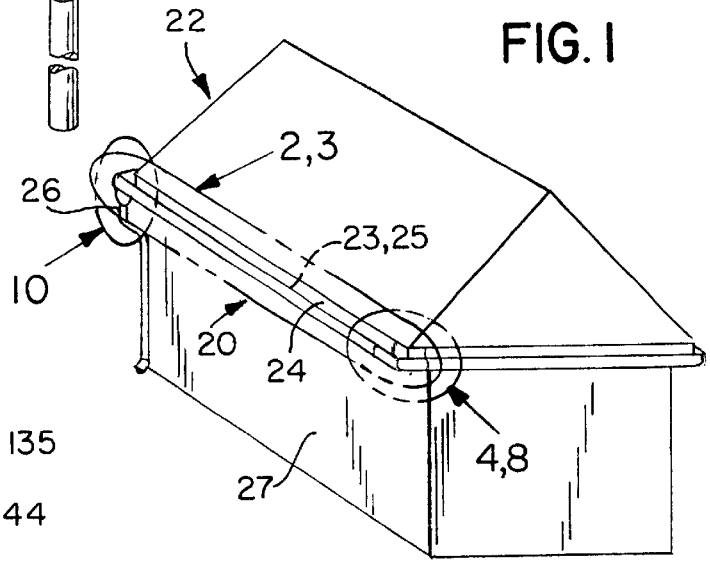
FIG.13
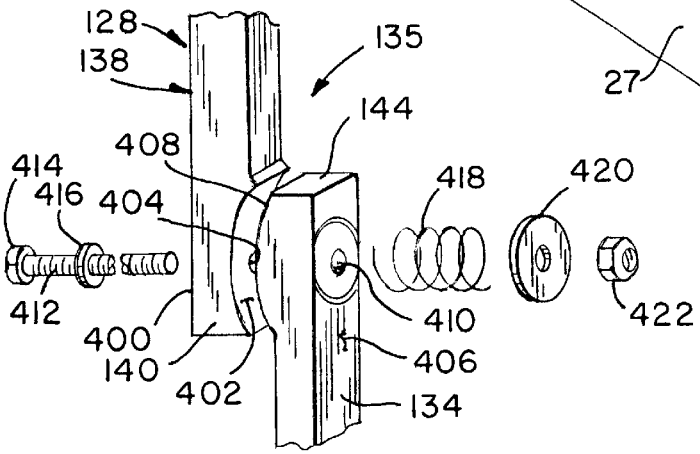

GUTTER AND DOWNSPOUT SYSTEM FOR FACILITATING CLEAN OUT AND PREVENTION OF BREAKAGE DUE TO ICE DAM BUILDUP

BACKGROUND OF THE INVENTION

1. Field of the Invention

The present invention relates to a gutter and downspout system. More particularly, the present invention relates to a gutter and downspout system for retractably mounting to a structure and facilitating clean out and prevention of breakage due to ice dam buildup.

2. Description of the Prior Art

Numerous innovations for pivotable gutter systems have been provided in the prior, art that will be described. Even though these innovations may be suitable for the specific individual purposes to which they address, however, they differ from the present invention.

A FIRST EXAMPLE, U.S. Pat. No. 4,309,792 to Faye teaches a hinged bracket assembly for use in mounting a drain trough beneath the eaves of a building and enabling the trough to be inverted to facilitate the cleaning and servicing thereof. The assembly is of sturdy construction comprised of two major components, each of which can be economically fabricated by cutting operations applied to an extruded structure.

A SECOND EXAMPLE, U.S. Pat. No. 4,745,657 to Faye teaches a hinged support bracket for a drain trough having a harness member which nests above a bracket member. Both harness and bracket members are joined by a hinge mechanism at their forward extremities, thereby permitting the harness member, containing the drain trough, to be forwardly rotated at least 180 degrees of circular arc, causing inversion of the trough and the discharge of any debris contained therein.

A THIRD EXAMPLE, U.S. Pat. No. 5,274,965 to Jackson teaches a gutter bracket assembly that includes a fascia bracket and a gutter bracket for rotating a gutter to effect cleaning debris therefrom. The fascia bracket including a rear panel adapted to be affixed vertically to a fascia board, a bottom panel extending from the rear panel, and a receiving portion located at an end of the bottom panel remote from the rear panel and including a first pivot member. The gutter bracket includes a frame member having a second pivot member. There is also provided a mechanism for attaching the first pivot member to the second pivot member for permitting rotation of the gutter bracket about the receiving portion of the fascia bracket so that the gutter bracket may be rotated between a first, rain-gathering position and a second, inverted position for emptying water and/or debris from the gutter. The gutter bracket includes a mechanism for securing the gutter to the frame member solely by a snap-fit of a portion of the frame about a portion of the gutter.

A FOURTH EXAMPLE, U.S. Pat. No. 5,335,460 to Smith Jr. teaches a hinged hanger system for pivotably attaching a rain gutter to the fascia of a building beneath the edge of a roof comprising a plurality of hinged hangers for mounting and supporting the rain gutter in a tiltable position, the hangers consisting of an "L" shaped bracket and a hinge section nestled within horizontal supports and pivotably hinged to the horizontal supports, and a pulley system with lines attached to the rain gutter for tilting the gutter to a dumping position and resetting the gutter to a receiving position.

A FIFTH EXAMPLE, U.S. Pat. No. 5,893,239 to Leahy teaches a gutter tilt actuator for a rain gutter system for a house, building, structure, etc., which facilitates cleaning of a gutter, and more particularly to a gutter tilt actuator, which is utilized to rotate the gutter from a water collecting position to a cleaning position and from a cleaning position to a water collecting position.

It is apparent that numerous innovationsfor pivotable gutter systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a gutter and downspout system for retractably mounting to a structure and facilitating clean out and prevention of breakage due to ice dam buildup that avoids the disadvantages of the prior art.

ANOTHER OBJECT of the present invention is to provide a gutter and downspout system for retractably mounting to a structure and facilitating clean out and prevention of breakage due to ice dam buildup that is simple and inexpensive to manufacture.

STILL ANOTHER OBJECT of the present invention is to provide a gutter and downspout system for retractably mounting to a structure and facilitating clean out and prevention of breakage due to ice dam buildup that is simple to use.

BRIEFLY STATED, YET ANOTHER OBJECT of the present invention is to provide a gutter and downspout system for retractably mounting to a structure and facilitating clean out and prevention of breakage due to ice dam buildup. The system includes a gutter arrangement that retractably mounts to the structure and facilitates clean out and prevention of breakage due to ice dam buildup and a downspout arrangement that detachably mounts to the gutter arrangement and retractably mounts to the structure and facilitates clean out and prevention of breakage due to ice dam buildup. The gutter arrangement includes a bracket that retractably mounts to the structure and a gutter that detachably mounts to the bracket. The downspout arrangement includes a bracket that retractably mounts to the structure and a downspout that detachably mounts to the bracket. The bracket of each of the gutter arrangement and the downspout arrangement includes a stationary portion that is affixed to the structure and a movable portion that is pivotally mounted to the stationary portion thereof.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention in use;

FIG. 8 is a diagrammatic elevational view of the area generally enclosed by the dotted curve identified by arrow 8 in FIG. 1 of a second embodiment of a corner piece of the gutter arrangement of the present invention;

FIG. 9 is an enlarged diagrammatic perspective view of the area generally enclosed by the dotted curve identified by arrow 9 in FIG. 8;

FIG. 12 is a diagrammatic top plan view taken generally in the direction of arrow 12 in FIG. 10 of the bracket of the downspout arrangement of the present invention;

FIG. 13 is an enlarged exploded diagrammatic perspective view of the area generally enclosed by the dotted curve identified by arrow 13 in FIG. 1 and FIG. 12.

LIST OF REFERENCE NUMERALS UTILIZED IN THE DRAWING

Figure 2:
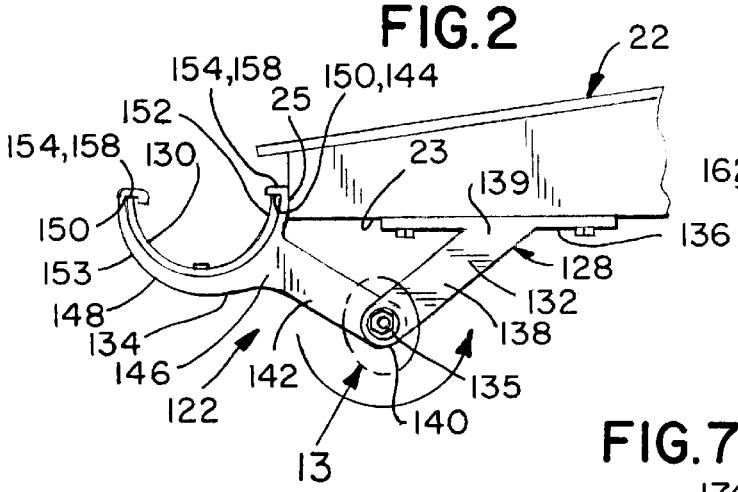
FIG. 2 is an enlarged diagrammatic end elevational view of the area generally enclosed by the dotted curve identified by arrow 2 in FIG. 1 of a first embodiment of the gutter arrangement of the present invention.
Figure 6:
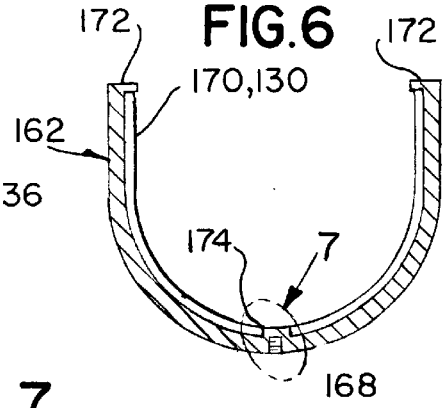
FIG. 6 is an enlarged diagrammatic cross sectional view taken on line 6—6 in FIG. 4.
Figure 7:
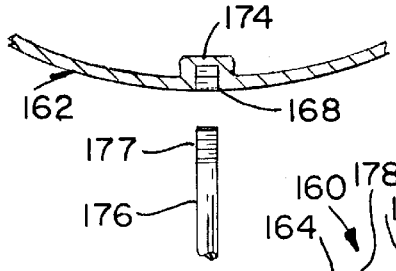
FIG. 7 is an enlarged fragmented diagrammatic elevational view of the area generally enclosed by the dotted curve identified by arrow 7 in FIG. 6.

20 gutter and downspout system of present invention for retractably mounting to structure 22 having eave 23 and facia 25 and facilitating clean out and prevention of breakage due to ice dam buildup
22 structure
23 eave of structure 22
24 gutter arrangement for retractably mounting to structure 22 and facilitating clean out and prevention of breakage due to ice dam buildup
25 facia of structure 22
26 downspout arrangement for retractably mounting to structure 22 and facilitating clean out and prevention of breakage due to ice dam buildup
27 side of structure 22

First Embodiment of Gutter Arrangement 122

122 gutter arrangement
128 bracket of gutter arrangement 122 for retractably mounting to structure 22 and extending perpendicularly to facia 23 of structure 22
130 gutter of gutter arrangement 122 for extending along facia 23 of structure 22
132 stationary portion of bracket 128 of gutter arrangement 122 for affixing to eave 23 of structure 22 and extending perpendicularly to facia 23 of structure 22
134 movable portion of bracket 128 of gutter arrangement 122 for extending past, and perpendicularly to, facia 25 of structure 22
136 base plate of stationary portion 132 of bracket 128 of gutter arrangement 122 for affixing to eave 23 of structure 22
138 stationary arm of stationary portion 132 of bracket 128 of gutter arrangement 122
139 first end of stationary arm 138 of stationary portion 132 of bracket 128 of gutter arrangement 122
140 second end of stationary arm 138 of stationary portion 132 of bracket 128 of gutter arrangement 122 for not extending past, but being perpendicularly to, facia 25 of structure 22
142 movable arm of movable portion 134 of bracket 128 of gutter arrangement 122
144 first end of movable arm 42 of movable portion 134 of bracket 125 of gutter arrangement 122
146 second end of movable arm 42 of movable portion 134 of bracket 128 of gutter arrangement 122 for aligning with, and extending perpendicularly to, facia 25 of structure 22
148 receiver of movable portion 134 of bracket 128 of gutter arrangement 122 for extending perpendicularly to facia 23 of structure 22
150 pair of uppermost ends of receiver 148 of movable portion 134 of bracket 128 of gutter arrangement 122
152 innermost end of pair of uppermost ends 150 of receiver 148 of movable portion 134 of bracket 128 of gutter arrangement 122 for abutting against facia 23 of structure 22
153 outermost end of pair of uppermost ends 150 of receiver 148 of movable portion 134 of bracket 128 of gutter arrangement 122
154 pair of lips of receiver 148 of movable portion 134 of bracket 128 of gutter arrangement 122
156 innermost lip of pair of lips 154 of receiver 148 of movable portion 134 of bracket 128 of gutter arrangement 122
158 outermost lip of pair of lips 154 of receiver 148 of movable portion 134 of bracket 128 of gutter arrangement 122

Second Embodiment of Gutter Arrangement 222

222 gutter arrangement
228 bracket of gutter arrangement 222
230 gutter of gutter arrangement 222
234 movable portion of bracket 228 of gutter arrangement 222
248 receiver of movable portion 234 of bracket 228 of gutter arrangement 222 for extending outwardly from facia 25 of structure 22, in line with eave 23 of structure 22
250 throughbore in receiver 248 of movable portion 234 of bracket 228 of gutter arrangement 222
251 stop of bracket 228 of movable portion 234 of gutter arrangement 222
252 lowermost surface of gutter 230 of gutter arrangement 222
253 rearwardmost surface of gutter 230 of gutter arrangement 222
254 blindbore in lowermost surface 252 of gutter 230 of gutter arrangement 222
256 bolt of gutter 230 of gutter arrangement 222

First Embodiment of Corner Gutter 160

160 corner gutter
162 first portion of corner gutter 160

163 pair of uppermost ends of first portion 162 of corner gutter 160
164 proximal end of first portion 162 of corner gutter 160
166 free distal end of first portion 162 of corner gutter 160
168 lowermost surface of first portion 162 of corner gutter 160
170 seal internally lining distal end 166 of first portion 162 of corner gutter 160
172 pair of clips of first portion 162 of corner gutter 160
174 bung of first portion 162 of corner gutter 160
176 stick of corner gutter 160
177 threaded end of stick 176 of corner gutter 160
178 second portion of corner gutter 160
180 pair of uppermost ends of second portion 178 of corner gutter 160
182 proximal end of second portion 178 of corner gutter 160
184 free distal end of second portion 178 of corner gutter 160
186 lowermost surface of second portion 178 of corner gutter 160
188 seal internally lining distal end 184 of second portion 178 of corner gutter 160
190 pair of clips of second portion 178 of corner gutter 160
192 bung of second portion 178 of corner gutter 160

Second Embodiment Of Corner Gutter 266

260 corner gutter
262 first portion of corner gutter 260
268 lowermost surface of first portion 262 of corner gutter 260
274 eyelet
277 hook
278 second portion of corner gutter 260
286 lowermost surface of second portion 278 of corner gutter 260

Downspout Arrangement 26

328 bracket of downspout arrangement 26 for retractably mounting to side 27 of structure 22 and extending perpendicularly to side 27 of structure 22
330 downspout of downspout arrangement 26
332 stationary portion of bracket 328 of downspout arrangement 26 for affixing to side.27 of structure 22 and extending perpendicularly to side 27 of structure 22
334 movable portion of bracket 328 of downspout arrangement 26 for extending past, and perpendicularly to, side 27.of structure 22
336 base plate of stationary portion 332 of bracket 328 of downspout arrangement 26 for affixing to side 27 of structure 22
338 stationary arm of stationary portion 332 of bracket 328 of downspout arrangement 26
339 first end of stationary arm 338 of stationary portion 332 of bracket 328 of downspout arrangement 26
340 second end of stationary arm 338 of stationary portion 332 of bracket 328 of downspout arrangement 26 for extending perpendicularly to side 27 of structure 22
342 movable arm of movable portion 334 of bracket 328 of downspout arrangement 26
344 first end of movable arm 342 of movable portion 334 of bracket 328 of downspout arrangement 26
346 second end of movable arm 342 of movable portion 334 of bracket 328 of downspout arrangement 26 for extending perpendicularly to side 27 of structure 22
348 receiver of movable portion 334 of bracket 328 of downspout arrangement 26 for extending perpendicularly to side 27 of structure 22
350 outermost ends of receiver 348 of movable portion 334 of bracket 328 of downspout arrangement 26
354 pair of lips of receiver 348 of movable portion 334 of bracket 328 of downspout arrangement 26
356 lower portion of downspout 330 of downspout arrangement 26 for extending perpendicularly to facia 23 of structure 22
358 upper portion of downspout 330 of downspout arrangement 26
360 uppermost end of lower portion 356 of downspout 330 of downspout arrangement 26
362 outermost surface of uppermost end 360 of lower portion 356 of downspout 330 of downspout arrangement 26
364 grooves in outermost surface 362 of uppermost end 360 of lower portion 356 of downspout 330 of downspout arrangement 26

Hinge 135

400 outermost surface of second end.140 of stationary arm 138 of stationary portion 132 of bracket 128 of gutter arrangement 122
402 innermost surface of second end 140 of stationary arm 138 of stationary portion 132 of bracket 128 of gutter arrangement 122
404 throughbore through second end 140 of stationary arm 138 of stationary portion 132 of bracket 128 of gutter arrangement 122
406 outermost surface of first end 144 of movable arm 134 of movable portion 134 of bracket 128 of gutter arrangement 122
408 innermost surface of first end 144 of movable arm 134 of movable portion 134 of bracket 128 of gutter arrangement 122
410 throughbore through first end 144 of movable arm 134 of movable portion 134 of bracket 128 of gutter arrangement 122
412 bolt of hinge 135
414 head of bolt 412 of hinge 135
416 first washer of hinge 135
418 coil spring of hinge 135
420 second washer of hinge 135
422 nut of hinge 135

DETAILED DESCRIPTION OF THE PREFERRED EMBODIMENT

Referring now to the figures, in which like numerals indicate like parts, and particularly to FIG. 1, the gutter and downspout system of the present invention is shown generally at 20 for retractably mounting to a structure 22 having an eave 23, a facia 25, and a side 27 and facilitating clean out and prevention of breakage due to ice dam buildup having weight.

The overall configuration of the gutter and downspout system 20 can best be seen in FIG. 1, and as such, will be discussed with reference thereto.

The gutter and downspout system 20 comprises a gutter arrangement 24 for retractably mounting to the structure 22 and facilitating clean out and prevention of breakage due to ice dam buildup, and a downspout arrangement 26 that is detachably mounted to the gutter arrangement 24 for retractably mounting to the structure 22 and facilitating clean out and prevention of breakage due to ice dam buildup.

The specific configuration of a first embodiment of the gutter arrangement 122 can best be seen in FIG. 2, and as such, will be discussed with reference thereto.

The gutter arrangement 122 comprises a bracket 128 for retractably mounting to the structure 22 and extending perpendicularly to the facia 23 of the structure 22, and a gutter 130 that is detachably mounted to the bracket 128 thereof.

The bracket 128 of the gutter arrangement 122 comprises a stationary portion 132 for affixing to the eave 23 of the structure 22 and extending perpendicularly to the facia 23 of the structure 22, and a movable portion 134 that is pivotally mounted, by a hinge 135, to the stationary portion 132 thereof for extending past, and perpendicularly to, the facia 25 of the structure 22.

The stationary portion 132 of the bracket 128 of the gutter arrangement 122 comprises a base plate 136 for affixing to the eave 23 of the structure 22.

The stationary portion 132 of the bracket 128 of the gutter arrangement 122 further comprises a stationary arm 138 that is slender, elongated, and has a first end 139 that is integrally formed on the base plate 136 thereof, and depends outwardly therefrom, to a second end 140 thereof for not extending past, but being perpendicularly to, the facia 25 of the structure 22.

The movable portion 134 of the bracket 128 of the gutter arrangement 122 comprises a movable arm 142 that is slender, elongated, and has a first end 144 that is pivotally attached to the second end 140 of the bracket 128 of the gutter arrangement 122, and extends outwardly and upwardly therefrom, to a second end 146 thereof for aligning with, and extending perpendicularly to, the facia 25 of the structure 22.

The movable portion 134 of the bracket 128 of the gutter arrangement 122 further comprises a receiver 148 that is vertically-oriented and integrally formed on the second end 146 of the movable arm 142 thereof for extending perpendicularly to the facia 23 of the structure 22.

The receiver 148 of the bracket 128 of the gutter arrangement 122 is semi-circular-shaped and opens upwardly to a pair of uppermost ends 150 that include an innermost end 152 for abutting against the facia 23 of the structure 22 and an outermost end 153.

The receiver 148 of the bracket 128 of the gutter arrangement 122 has a pair of lips 154 that extend inwardly towards each other, from the pair of uppermost ends 150 thereof, respectively.

The pair of lips 154 of the receiver 148 of the bracket 128 of the gutter arrangement 122 include an innermost lip 156 that extends inwardly from the innermost end 152 of the receiver 148 of the bracket 128 of the gutter arrangement 122 and an outermost lip 158 that extends inwardly from the outermost end 153 of the receiver 148 of the bracket 128 of the gutter arrangement 122.

The innermost lip 156 of the receiver 148 of the bracket 128 of the gutter arrangement 122 is straight and horizontally-oriented.

The outermost lip 158 of the receiver 148 of the bracket 128 of the gutter arrangement 122 is L-shaped and extends horizontally and then depends vertically.

The gutter 130 is horizontally-oriented, slender, elongated, semi-circular-shaped in lateral cross section, and is snapingly and detachably received in, conforms to, and extends perpendicularly to, the receiver 148 of the bracket 128 of the gutter arrangement 122 for extending along the facia 23 of the structure 22.

The gutter 130 is detachably captured by the pair of lips 154 of, and selectively maintained in, the receiver 148 of the bracket 128 of the gutter arrangement 122, and when the gutter 130 is to be cleaned out, the movable portion 134 of the bracket 128 of the gutter arrangement 122 is pivoted downwardly exposing the gutter 130 and facilitating the clean out thereof, and when the gutter 130 fills with the ice dam buildup, the weight of the ice dam buildup causes the movable portion 134 of the bracket 128 of the gutter arrangement 122 to pivot downwardly causing the ice dam build up to empty from the gutter 130 without breakage thereto that would have occurred had the bracket 128 of the gutter arrangement 122 been rigid and inflexible.

Figure 3:
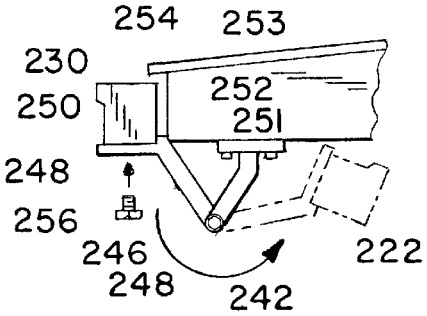
FIG. 3 is an enlarged diagrammatic end elevational view of the area generally enclosed by the dotted curve identified by arrow 3 in FIG. 1 of a second embodiment of the gutter arrangement of the present invention.
Figure 4:
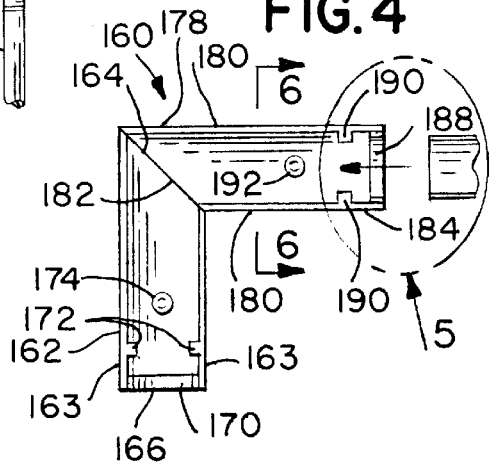
FIG. 4 is an enlarged diagrammatic top plan view of the, area generally enclosed by the dotted curve identified by arrow 4 in FIG. 1 of a first embodiment of a corner piece of the gutter arrangement of the present invention shown in FIG. 2.
Figure 5:
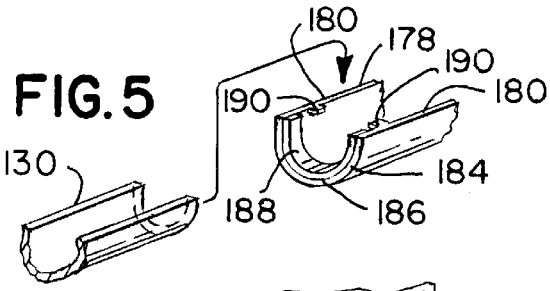
FIG. 5 is an exploded diagrammatic perspective view of the area generally enclosed by the dotted curve identified by arrow 5 in FIG. 4.

The specific configuration of a second embodiment of the gutter arrangement 222 can best be seen in FIG. 3, and as such, will be discussed with reference thereto.

The gutter arrangement 222 is similar to the gutter arrangement 122, except for the receiver 248 of the bracket 228 thereof and the gutter 230 thereof.

The receiver 248 of the bracket 228 of the gutter arrangement 222 is flat and horizontally-oriented for extending outwardly from the facia 25 of the structure 22, in line with the eave 23 of the structure 22.

The receiver 248 of the bracket 228 of the gutter arrangement 222 has a throughbore 250 that extends vertically therethrough.

The bracket 228 of the gutter arrangement 222 further has a stop 251 that is disposed on the second end 246 of the movable arm 242 of the movable portion 234 of the bracket 228 of the gutter arrangement 222.

The gutter 230 is slender, elongated, square-shaped in lateral cross section, and has a lowermost surface 252 that is flat and rests on the receiver 248 of the bracket 228 of the gutter arrangement 222 and a rearwardmost surface 253 that abuts against the stop 251 of the receiver 248 of the bracket 228 of the gutter arrangement 222.

The gutter 230 has a blindbore 254 that extends upwardly from, and opens into, the lowermost surface 252 thereof.

The gutter 230 further comprises a bolt 256 that extends into the throughbore 250 in the receiver 148 of the bracket 128 of the gutter arrangement 222 and threadably into the blindbore 254 therein so as to selectively maintain the gutter 230 in the receiver 248 of the movable portion 234 of the bracket 228 of the gutter arrangement 222.

The specific configuration of a first embodiment of a corner gutter 160 for use with the gutter arrangement 122 can best be seen in FIGS. 4–7, and as such, will be discussed with reference thereto.

The corner gutter 160 comprises a first portion 162 that is slender, elongated, semi-circular-shaped in lateral cross section, opens upwardly to a pair of uppermost ends 163, and has a proximal end 164, a free distal end 166, and a lowermost surface 168.

The proximal end 164 of the first portion 162 of the corner gutter 160 is mitered at 45 degrees.

The distal end 166 of the first portion 162 of the corner gutter 160 is lined internally with a seal 170.

The first portion 162 of the corner gutter 160 further has a pair of clips 172 that extend inwardly towards each other, from the pair of uppermost ends 163 thereof, respectively, and are disposed just inboard of the distal end 166 thereof.

The gutter 130 adjacent thereto conforms to, and is detachably captured in, the distal end 166 of the first portion 162 of the corner gutter 160, is sealed against leakage by the seal 170 thereof, and is selectively maintained therein by the pair of clips 172 abutting there against so as to form a breakaway joint that allows the gutter 130 adjacent thereto to separate from the first portion 162 of the corner gutter 160 when the weight of the ice dam buildup is great so as to prevent the bracket 128 from pivoting downwardly past its limit and breaking.

The first portion 162 of the corner gutter 160 further has a bung 174 that is internally threaded, and extends inwardly from, and opens into, the lowermost surface 168 thereof, and is disposed intermediate the proximal end 164 thereof and the distal end 166 thereof.

The corner gutter 160 further comprises a second portion 178 that is slender, elongated, semi-circular-shaped in lateral cross section, opens upwardly to a pair of uppermost ends 180, and has a proximal end 182, a free distal end 184, and a lowermost surface 186.

The proximal end 182 of the second portion 178 of the corner gutter 160 is mitered at 45 degrees and is coincident with, for movement with, the proximal end 164 of the first portion 162 of the corner gutter 160 causing the first portion 162 of the corner gutter 160 to be positioned 90 degrees relative to the second portion 178 of the corner gutter 160 and form a right corner.

The distal end 184 of the second portion 178 of the corner gutter 160 is lined internally with a seal 188.

The second portion 178 of the corner gutter 160 further has a pair of clips 190 that extend inwardly towards each other, from the pair of uppermost ends 180 thereof, respectively, and are disposed just inboard of the distal end 184 thereof.

The gutter 130 adjacent thereto conforms to, and is detachably captured in, the distal end 184 of the second portion 178 of the corner gutter 160, is sealed against leakage by the seal 188 thereof, and is selectively maintained therein by the pair of clips 190 abutting there against so as to form a breakaway joint that allows the gutter 130 adjacent thereto to separate from the second portion 178 of the corner gutter 160 when the weight of the ice dam buildup is great so as to prevent the bracket 128 from pivoting downwardly past its limit and breaking.

The second portion 178 of the corner gutter 160 further has a bung 192 that is internally threaded, and extends inwardly from, and opens into, the lowermost surface 186 of the second gutter 178 of the corner gutter 160, and is disposed intermediate the proximal end 182 thereof and the distal end 164 thereof.

The corner gutter 160 further has a stick 176 that has a threaded end 177 that selectively threads into one of the bung 174 in the first portion 162 thereof and the bung 192 in the second portion 178 thereof, and when the corner gutter 160 and the gutter 130 adjacent thereto are to be cleaned out, the stick 176 is threaded into the one of the bung 174 in the first portion 162 thereof and the bung 192 in the second potion 178 thereof and pulled down, causing the movable portion 134 of the bracket 128 of the gutter arrangement 122 to pivot downwardly and expose the corner gutter 160 and the gutter 130 adjacent thereto so as to facilitate the clean out thereof, and thereafter, the stick 176 is pushed up repositioning the corner gutter 160 and the gutter 130 adjacent thereto to their original positions, and the stick 176 is unthreaded and removed therefrom, and when the corner gutter 160 and the gutter 130 adjacent thereto fill with the ice dam buildup, and the movable portion 134 of the bracket 128 of the gutter arrangement 122 pivots downwardly, and after the ice dam build up has emptied from the corner gutter 160 and the gutter 130 adjacent thereto, the stick 176 is threaded into the one of the bung 174 in the first portion 162 thereof and the bung 192 in the second portion 178 thereof, and the stick 176 is pushed up repositioning the corner gutter 160 and the gutter 130 adjacent thereto to their original positions, and the, stick 176 is unthreaded and removed therefrom.

The specific configuration of a second embodiment of the corner gutter 260 can best be seen in FIGS. 8 and 9, and as such, will be discussed with reference thereto.

The corner gutter 260 is similar to the corner gutter 160, except: 1. The bung 174 in the first portion 162 thereof and the bung 192 in the second portion 178 thereof are each replaced by an eyelet 274 that depends from the lowermost surface 268 of the first portion 262 and the lowermost surface 286 of the second portion 278, respectively.

2. The threaded end 177 of the stick 176 is replaced by a hook 277 that selectively engages in the eyelet 274.

Figure 10:
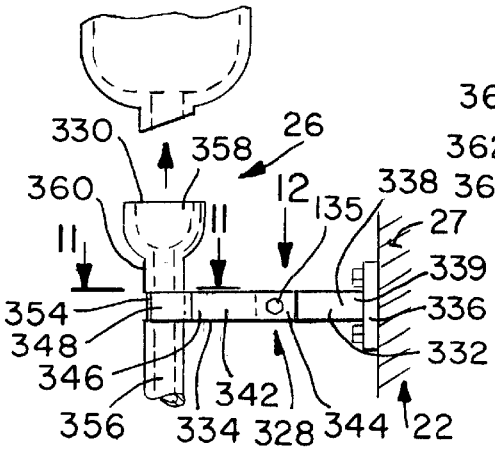
FIG. 10 is an enlarged diagrammatic elevational view of the area generally enclosed by the dotted curve identified by arrow 10 in FIG. 1 of the downspout arrangement of the present invention for utilization with the gutter arrangement of the present invention shown in FIG. 2.
Figure 11:
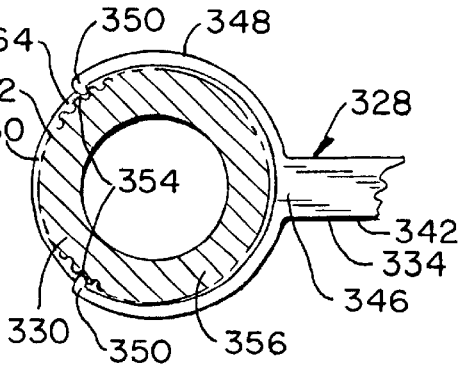
FIG. 11 is an enlarged diagrammatic cross sectional view taken on line 11 in FIG. 10.

The specific configuration of the downspout arrangement 26 can best be seen in FIGS. 10–12, and as such, will be discussed with reference thereto.

The downspout arrangement 26 comprises a bracket 328 for retrabtably mounting to, and extending perpendicularly to, the side 27 of the structure 22, and a downspout 330 that is detachably mounted to the bracket 328 thereof.

The bracket 328 of the downspout arrangement 26 comprises a stationary portion 332 for affixing to, and extending perpendicularly to, the side 27 of the structure 22, and a movable portion 334 that is pivotally mounted, by another of the hinge 135, to the stationary portion 332 thereof for extending perpendicularly to the side 27 of the structure 22.

The stationary portion 332 of the bracket 328 of the downspout arrangement 26 comprises a base plate 336 for affixing to the side 27 of the structure 22.

The stationary portion 332 of the bracket 328 of the downspout arrangement 26 further comprises a stationary arm 338 that is slender, elongated, and has a first end 339 that is integrally formed on the base plate 336 thereof, and extends horizontally outwardly therefrom, to a second end 340 thereof for extending perpendicularly to the side 27 of the structure 22.

The movable portion 334 of the bracket 328 of the downspout arrangement 26 comprises a movable arm 342 that is slender, elongated, and has a first end 344 that is pivotally attached to the second end 340 of the stationary arm 338 of the bracket 328 of the downspout arrangement 26, and extends colinearly outwardly therefrom, to a second end 346 thereof for extending perpendicularly to the side 27 of the structure 22.

The movable portion 334 of the bracket 328 of the downspout arrangement 26 further comprises a receiver 348 that is horizontally-oriented and integrally formed on the second end 346 of the movable arm 342 thereof for extending perpendicularly to the side 27 of the structure 22.

The receiver 348 of the bracket 328 of the downspout arrangement 26 is C-shaped and opens outwardly to a pair of outermost ends 350.

The receiver 348 of the bracket 328 of the downspout arrangement 26 has a pair of lips 354 that extend inwardly towards each other, from the pair of outermost ends 350 thereof, respectively.

The downspout 330 has a lower portion 356 that is detachably connected to the bracket 328 of the downspout arrangement 26, and an upper portion 358 that fluidly communicates with the lower portion 356 thereof and the gutter 130.

The lower portion 356 of the downspout 330 is tubular, vertically-oriented, slender, elongated, circular-shaped in lateral cross section, and is snapingly and detachably received in, conforms to, and extends perpendicularly to, the receiver 348 of the bracket 328 of the downspout arrangement 322 for extending perpendicularly to the facia 23 of the structure 22, and has an uppermost end 360.

The uppermost end 360 of the lower portion 356 of the downspout 330 has an outermost surface 362 that has grooves 364 that extend partially therearound, are straight, vertically-oriented, and horizontally spaced-apart from each other.

The upper portion 330 of the downspout 330 is cup-shaped and extends coaxially upwardly from, and fluidly communicates with, the uppermost end 360 of the lower portion 356 of the downspout 330, and detachably receives, and fluidly communicates with, the gutter 130.

The lower portion 356 of the downspout 330 is detachably captured in the receiver 348 of the bracket 328 of the downspout arrangement 322 by the pair of lips 354 of the receiver 348 of the bracket 328 of the downspout arrangement 26 selectively engaging in an associated pair of the grooves 364 in the uppermost end 360 thereof.

The specific configuration of the hinge 135 can best be seen in FIG. 13, and as such, will be discussed with reference thereto.

The hinge 135 comprises the second end 140 of the stationary arm 138 of the bracket 128 of the gutter arrangement 122 having an outermost surface 400, an innermost surface 402 being concave, and a throughbore 404 extending horizontally therethrough, from the innermost surface 402 thereof to the outermost surface 400 thereof.

The hinge 135 further comprises the first end 144 of the movable arm 134 of the bracket 128 of the gutter arrangement 122 having an outermost surface 406, an innermost surface 408 being convex, and conforming to, and rotating in the concave of the second end 140 of the stationary arm 138 of the bracket 128 of the gutter arrangement 122, and a throughbore 410 extending horizontally therethrough, from the innermost surface 408 thereof to the outermost surface 406 thereof.

The hinge 135 further comprises a bolt 412 that has a head 414 and extends in the throughbore 404 in the second end 140 of the stationary arm 138,of the bracket 128 of the gutter arrangement 122 and the throughbore 410 in the first end 144 of the movable arm 134 of the bracket 128 of the gutter arrangement 122.

The hinge 135 further comprises a first washer 416 that has the bolt 412 pass therethrough, and is disposed between the head 414 of the bolt 412 and the outermost surface 400 of the second end 140 of the stationary arm 138 of the bracket 128 of the gutter arrangement 122.

The hinge 135 further comprises a coil spring 418 that has tension and the bolt 412 pass therethrough, and is disposed against the outermost surface 406 of the first end 144 of the movable arm 134 of the bracket 128 of the gutter arrangement 122.

The hinge 135 further comprises a second washer 420 that has the bolt 412 pass therethrough, and is disposed against the coil spring 418, and captures the coil spring 418 against the outermost surface 406 of the first end 144 of the movable arm 134 of the bracket 128 of the gutter arrangement 122.

The hinge 135 further comprises a nut 422 that threadably engages the bolt 412, and is disposed against the second washer 420 thereof, and when threaded relative to the bolt 412, changes the tension of the coil spring 418 thereof for determining at what weight of the ice dam buildup, the movable arm 134 of the bracket 128 of the gutter arrangement 122 will pivot downwardly.

It will be understood that each of the elements described above, or two or more together, may also find a useful application in other types of constructions different from the types described above.

While the invention has been illustrated and described as embodied in a gutter and downspout system for retractably mounting to a structure and facilitating clean out and prevention of breakage due to ice dam buildup, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A gutter and downspout system for retractably mounting to structure having an eave, a facia, and a side, and facilitating clean out and prevention of breakage due to ice dam buildup having weight, said system comprising:

A) a gutter arrangement for retractably mounting to the structure and facilitating clean out and prevention of breakage due to ice dam buildup; and B) a downspout arrangement detachably mounted to said gutter arrangement for retractably mounting to the structure and facilitating clean out and prevention of breakage due to ice dam buildup, wherein said gutter arrangement comprises:

I) a bracket for retractably mounting to the structure and extending perpendicularly to the facia of the structure; and II) a gutter that is detachably mounted to said bracket thereof, wherein said bracket of said gutter arrangement comprises:

i) a stationary portion for affixing to the eave of the structure and extending perpendicularly to the facia of the structure; and ii) a movable portion that is pivotally mounted to said stationary portion thereof, by a hinge, for extending past, and perpendicularly to, the facia of the structure, wherein said stationary portion of said bracket of said gutter arrangement comprises a base plate for affixing to the eave of the structure, wherein said stationary portion of said bracket of said gutter arrangement further comprises a stationary arm that is slender, elongated, and has a first end that is integrally formed on said base plate thereof, and depends outwardly therefrom, to a second end for not extending past, but being perpendicularly to, the facia of the structure, wherein said movable portion of said bracket of said gutter arrangement comprises a movable arm that is slender, elongated, and has a first end that is pivotally attached to said second end of said stationary arm of said bracket of said gutter arrangement, and extends outwardly and upwardly therefrom, to a second end for aligning with, and extending perpendicularly to, the facia of the structure, wherein said movable portion of said bracket of said gutter arrangement further comprises a receiver that is vertically-oriented and integrally formed on said second end of said movable arm thereof for extending perpendicularly to the facia of the structure, wherein said receiver of said bracket of said gutter arrangement has a throughbore that extends vertically therethrough, wherein said bracket of said gutter arrangement further has a stop that is disposed on said second end of said movable arm of said movable portion of said bracket of said gutter arrangement, wherein said gutter is slender, elongated, square-shaped in lateral cross section, and has:

a) a lowermost surface that is flat and rests on said receiver of said bracket of said gutter arrangement; and b) a rearwardmost surface that abuts against said stop of said receiver of said bracket of said gutter arrangement, wherein said gutter has a blindbore that extends upwardly from, and opens into, said lowermost surface thereof.

2. The system as defined in claim 1, wherein said receiver of said bracket of said gutter arrangement is semi-circular-shaped and opens upwardly to a pair of uppermost ends that include:

a) an innermost end for abutting against the facia of the structure; and b) an outermost end.

3. The system as defined in claim 2, wherein said receiver of said bracket of said gutter arrangement has a pair of lips that extend inwardly towards each other, from said pair of uppermost ends thereof, respectively.

4. The system as defined in claim 3, wherein said pair of lips of said receiver of said bracket of said gutter arrangement include:

a) an innermost lip that extends inwardly from said innermost end of said receiver of said bracket of said gutter arrangement; and b) an outermost lip that extends inwardly from said outermost end of said receiver of said bracket of said gutter arrangement.

5. The system as defined in claim 4, wherein said innermost lip of said receiver of said bracket of said gutter arrangement is straight and horizontally-oriented.

6. The system as defined in claim 4, wherein said outermost lip of said receiver of said bracket of said gutter arrangement is L-shaped and extends horizontally and then depends vertically.

7. The system as defined in claim 2, wherein said gutter is horizontally-oriented, slender, elongated, semi-circular-shaped in lateral cross section, and is snapingly and detachably received in, conforms to, and extends perpendicularly to, said receiver of said bracket of said gutter arrangement for extending along the facia of said structure.

8. The system as defined in claim 3, wherein said gutter is detachably captured by said pair of lips of, and selectively maintained in, said receiver of said bracket of said gutter arrangement, and when said gutter is to be cleaned out, said movable portion of said bracket of said gutter arrangement is pivoted downwardly exposing said gutter and facilitating the clean out thereof, and when said gutter fills with the ice dam buildup, the weight of the ice dam buildup causes said movable portion of said bracket of said gutter arrangement to pivot downwardly causing, the ice dam build up to empty from said gutter without breakage thereto that would have occurred had said bracket of said gutter arrangement been rigid and inflexible.

9. The system as defined in claim 1, wherein said receiver of said bracket of said gutter arrangement is flat and horizontally-oriented for extending outwardly from the facia of the structure, in line with the eave of the structure.

10. The system as defined in claim 1, wherein said gutter further comprises a bolt that extends into said throughbore in said receiver of said bracket of said gutter arrangement and threadably into said blindbore therein so as to selectively maintain said gutter in said receiver of said movable portion of said bracket of said gutter arrangement.

11. A gutter and downspout system for retractably mounting to structure having an eave, a facia, and a side, and facilitating clean out and prevention of breakage due to ice dam buildup having weight, said system comprising:

A) a gutter arrangement for retractably mounting to the structure and facilitating clean out and prevention of breakage due to ice dam buildup; and B) a downspout arrangement detachably mounted to said gutter arrangement for retractably mounting to the structure and facilitating clean out and prevention of breakage due to ice dam buildup, wherein said gutter arrangement comprises:

I) a bracket for retractably mounting to the structure and extending perpendicularly to the facia of the structure; and II) a gutter that is detachably mounted to said bracket thereof, wherein said gutter arrangement further comprises a corner gutter, wherein said corner gutter comprises a first portion that is slender, elongated, semi-circular-shaped in lateral cross section, opens upwardly to a pair of uppermost ends, and has:

a) a proximal end;

b) a free distal end; and c) a lowermost surface, wherein said distal end of said first portion of said corner gutter is lined internally with a seal, wherein said first portion of said corner gutter further has a pair of clips that extend inwardly towards each other, from said pair of uppermost ends thereof, respectively, and are disposed just inboard of said distal end thereof.

12. The system as defined in claim 11, wherein said proximal end of said first portion of said corner gutter is mitered at 45 degrees.

13. The system as defined in claim 11, wherein said gutter adjacent thereto conforms to, and is detachably captured in, said distal end of said first portion of said corner gutter, is sealed against leakage by said seal thereof, and is selectively maintained therein by said pair of clips abutting there against so as to form a breakaway joint that allows said gutter adjacent thereto to separate from said first portion of said corner gutter when the weight of the ice dam buildup is great so as to prevent said bracket from pivoting downwardly past its limit and breaking.

14. A gutter and downspout system for retractably mounting to structure having an eave, a facia, and a side, and facilitating clean out and prevention of breakage due to ice dam buildup having weight, said system comprising:

A) a gutter arrangement for retractably mounting to the structure and facilitating clean out and prevention of breakage due to ice dam buildup; and B) a downspout arrangement detachably mounted to said gutter arrangement for retractably mounting to the structure and facilitating clean out and prevention of breakage due to ice dam buildup, wherein said gutter arrangement comprises:

I) a bracket for retractably mounting to the structure and extending perpendicularly to the facia of the structure; and II) a gutter that is detachably mounted to said bracket thereof, wherein said gutter arrangement further comprises a corner gutter, wherein said corner gutter comprises a first portion that is slender, elongated, semi-circular-shaped in lateral cross section, opens upwardly to a pair of uppermost ends, and has:

a) a proximal end;

b) a free distal end; and c) a lowermost surface, wherein said first portion of said corner gutter further has a bung that is internally threaded, and extends inwardly from, and opens into, said lowermost surface thereof, and is disposed intermediate said proximal end thereof and said distal end thereof.

15. The system as defined in claim 14, wherein said corner gutter further comprises a second portion that is slender, elongated, semi-circular-shaped in lateral cross section, opens upwardly to a pair of uppermost ends, and has:

a) a proximal end;

b) a free distal end; and c) a lowermost surface.

16. The system as defined in claim 15, wherein said proximal end of said second portion of said corner gutter is mitered at 45 degrees and is coincident with, for movement with, said proximal end of said first portion of said corner gutter causing said first portion of said corner gutter to be positioned 90 degrees relative to said second portion of said corner gutter and form a right corner.

17. The system as defined in claim 15, wherein said distal end of said second portion of said corner gutter is lined internally with a seal.

18. The system as defined in claim 17, wherein said second portion of said corner gutter further has a pair of clips that extend inwardly towards each other, from said pair of uppermost ends thereof, respectively, and are disposed just inboard of said distal end thereof.

19. The system as defined in claim 18, wherein said gutter adjacent thereto conforms to, and is detachably captured in, said distal end of said second portion of said corner gutter, is sealed against leakage by said seal thereof, and is selectively maintained therein by said pair of clips abutting there against so as to form a breakaway joint that allows said gutter adjacent thereto to separate from said second portion of said corner gutter when the weight of the ice dam buildup is great so as to prevent said bracket from pivoting downwardly past its limit and breaking.

20. The system as defined in claim 15, wherein said second portion of said corner gutter further has a bung that is internally threaded, and extends inwardly from, and opens into, said lowermost surface of said second gutter of said corner gutter, and is disposed intermediate said proximal end thereof and said distal end thereof.

21. The system as defined in claim 20, wherein said corner gutter further has a stick that has a threaded end that selectively threads into one of said bung in said first portion thereof and said bung in said second portion thereof, and when said corner gutter and said gutter adjacent thereto are to be cleaned out, said stick is threaded into said one of said bung in said first portion thereof and said bung in said second potion thereof and pulled down, causing said movable portion of said bracket of said gutter arrangement to pivot downwardly and expose said corner gutter and said gutter adjacent thereto so as to facilitate the clean out thereof, and thereafter, said stick is pushed up repositioning said corner gutter and said gutter adjacent thereto to their original positions, and said stick is unthreaded and removed therefrom, and when said corner gutter and said gutter adjacent thereto fill with the ice dam buildup, and said movable portion of said bracket of said gutter arrangement pivots downwardly, and after the ice dam build up has emptied from said corner gutter and said gutter adjacent thereto, said stick is threaded into said one of said bung in said first portion thereof and said bung in said second portion thereof, and said stick is pushed up repositioning said corner gutter and said gutter adjacent thereto to their original positions, and said stick is unthreaded and removed therefrom.

22. The system as defined in claim 15, wherein said first portion of said corner gutter further has a eyelet that depends from said lowermost surface thereof, and is disposed intermediate said proximal end thereof and said distal end thereof.

23. The system as defined in claim 22, wherein said second portion of said corner gutter further has a eyelet that depends from said lowermost surface thereof, and is disposed intermediate said proximal end thereof and said distal end thereof.

24. The system as defined in claim 23, wherein said corner gutter further has a stick that has a hooked end that selectively hooks into one of said eyelet of said first portion thereof and said eyelet of said second portion thereof, and when said corner gutter and said gutter adjacent thereto are to be cleaned out, said stick is hooked into said one of said eyelet of said first portion thereof and said eyelet of said second potion thereof and pulled down, causing said movable portion of said bracket of said gutter arrangement to pivot downwardly and expose said corner gutter and said gutter adjacent thereto so as to facilitate the clean out thereof, and thereafter, said stick is pushed up repositioning said corner gutter and said gutter adjacent thereto to their original positions, and said stick is unhooked and removed therefrom, and when said corner gutter and said gutter adjacent thereto fill with the ice dam buildup, and said movable portion of said bracket of said gutter arrangement pivots-downwardly, and after the ice dam build up has emptied from said corner gutter and said gutter adjacent thereto, said stick is hooked into said one of said eyelet of said first portion thereof and said eyelet of said second portion thereof, and said stick is pushed up repositioning said corner gutter and said gutter adjacent thereto to their original positions, and said stick is unhooked and removed therefrom.

25. A gutter and downspout system for retractably mounting to structure having an eave, a facia, and a side, and facilitating clean out and prevention of breakage due to ice dam buildup having weight, said system comprising:

A) a gutter arrangement for retractably mounting to the structure and facilitating clean out and prevention of breakage due to ice dam buildup; and B) a downspout arrangement detachably mounted to said gutter arrangement for retractably mounting to the structure and facilitating clean out and prevention of breakage due to ice dam buildup, wherein said gutter arrangement comprises:

I) a bracket for retractably mounting to the structure and extending perpendicularly to the facia of the structure; and II) a gutter that is detachably mounted to said bracket thereof, wherein said bracket of said gutter arrangement comprises:

i) a stationary portion for affixing to the eave of the structure and extending perpendicularly to the facia of the structure; and ii) a movable portion that is pivotally mounted to said stationary portion thereof, by a hinge, for extending past, and perpendicularly to, the facia of the structure, wherein said stationary portion of said bracket of said gutter arrangement comprises a base plate for affixing to the eave of the structure, wherein said stationary portion of said bracket of said gutter arrangement further comprises a stationary arm that is slender, elongated, and has a first end that is integrally formed on said base plate thereof, and depends outwardly therefrom, to a second end for not extending past, but being perpendicularly to, the facia of the structure, wherein said movable portion of said bracket of said gutter arrangement comprises a movable arm that is slender, elongated, and has a first end that is pivotally attached to said second end of said stationary arm of said bracket of said gutter arrangement, and extends outwardly and upwardly therefrom, to a second end for aligning with, and extending perpendicularly to, the facia of the structure, wherein said downspout arrangement comprises:

a) a bracket for retractably mounting to, and extending perpendicularly to, the side of the structure; and b) a downspout that is detachably mounted to said bracket thereof.

26. The system as defined in claim 25, wherein said bracket of said downspout arrangement comprises:

a) a stationary portion for affixing to, and extending perpendicularly to, the side of the structure; and c) a movable portion that is pivotally mounted, by another said hinge, to said stationary portion thereof for extending past, and perpendicularly to, the side of the structure.

27. The system as defined in claim 26, wherein said stationary portion of said bracket of said downspout arrangement comprises a base plate for affixing to the side of the structure.

28. The system as defined in claim 27, wherein said stationary portion of said bracket of said downspout arrangement further comprises a stationary arm that is slender, elongated, and has a first end that is integrally formed on said base plate thereof, and extends horizontally outwardly therefrom, to a second end thereof for extending perpendicularly to the side of the structure.

29. The system as defined in claim 28, wherein said movable portion of said bracket of said downspout arrangement comprises a movable arm that is slender, elongated, and has a first end that is pivotally attached to said second end of said stationary arm of said bracket of said downspout arrangement, and extends colinearly outwardly therefrom, to a second end thereof for extending perpendicularly to the side of the structure.

30. The system as defined in claim 29, wherein said movable portion of said bracket of said downspout arrangement further comprises a receiver that is horizontally-oriented and integrally formed on said second end of said movable arm thereof for extending perpendicularly to the side of the structure.

31. The system as defined in claim 30, wherein said receiver of said bracket of said downspout arrangement is C-shaped and opens outwardly to a pair of outermost ends.

32. The system as defined in claim 31, wherein said receiver of said bracket of said downspout arrangement has a pair of lips that extend inwardly towards each other, from said pair of outermost ends thereof, respectively.

33. The system as defined in claim 32, wherein said downspout has:

a) a lower portion that is detachably connected to said bracket of said downspout arrangement; and b) an upper portion that fluidly communicates with said lower portion thereof and said gutter.

34. The system as defined in claim 33, wherein said lower portion of said downspout is tubular, vertically-oriented, slender, elongated, circular-shaped in lateral cross section, and is snapingly and detachably received in, conforms to, and extends perpendicularly to, said receiver of said bracket of said downspout arrangement for extending perpendicularly to the facia of the structure, and has an uppermost end.

35. The system as defined in claim 34, wherein said uppermost end of said lower portion of said downspout has an outermost surface that has grooves that extend partially thereround, are straight, vertically-oriented, and horizontally spaced-apart from each other.

36. The system as defined in claim 34, wherein said upper portion of said downspout is cup-shaped and extends coaxially upwardly from, and fluidly communicates with, said uppermost end of said lower portion of said downspout, and detachably receives, and fluidly communicates with, said gutter.

37. The system as defined in claim 35, wherein said lower portion of said downspout is detachably captured in said receiver of said bracket of said downspout arrangement by said pair of lips of said receiver of said bracket of said downspout arrangement selectively detachably engaging in an associated pair of said grooves in said uppermost end thereof.

38. The system as defined in claim 29, wherein said hinge comprises said second end of said stationary arm of said bracket of each of said gutter arrangement and said downspout arrangement having:

a) an outermost surface;

b) an innermost surface being concave; and c) a throughbore extending horizontally therethrough, from said innermost surface thereof to said outermost surface thereof.

39. The system as defined in claim 38, wherein said hinge further comprises said first end of said movable arm of said bracket of each of said gutter arrangement and said downspout arrangement having:

a) an outermost surface;

b) an innermost surface being convex, and conforming to, and rotating in said concave of said second end of said stationary arm of said bracket of an associated one of said gutter arrangement and said downspout arrangement; and c) a throughbore extending horizontally therethrough, from said innermost surface thereof to said outermost surface thereof.

40. The system as defined in claim 39, wherein said hinge further comprises a bolt that has a head and extends in said throughbore in said second end of said stationary arm of said bracket of said associated one of said gutter arrangement and downspout arrangement and said throughbore in said first end of said movable arm of said bracket of said associated one of said gutter arrangement and said downspout arrangement.

41. The system as defined in claim 40, wherein said hinge further comprises a first washer that has said bolt pass therethrough, and is disposed between said head of said bolt and said outermost surface of said second end of said stationary arm of said bracket of said associated one of said gutter arrangement and said downspout arrangement.

42. The system as defined in claim 40, wherein said hinge further comprises a coil spring that has tension and said bolt pass therethrough, and is disposed against said outermost surface of said first end of said movable arm of said bracket of said associated one of said gutter arrangement and said downspout arrangement.

43. The system as defined in claim 42, wherein said hinge further comprises a second washer that has said bolt pass therethrough, and is disposed against said coil spring, and captures said coil spring against said outermost surface of said first end of said movable arm of said bracket of said associated one of said gutter arrangement and said downspout arrangement.

44. The system as defined in claim 43, wherein said hinge further comprises a nut that threadably engages said bolt, and is disposed against said second washer thereof, and when threaded relative to said bolt, changes said tension of said coil spring thereof for determining at what weight of the ice dam buildup, said movable arm of said bracket of said associated one of said gutter arrangement and said downspout arrangement will pivot downwardly.

* * * * *